US012674314B2

(12) United States Patent
Viviano

(10) Patent No.: US 12,674,314 B2
(45) Date of Patent: Jul. 7, 2026

(54) APPARATUS AND METHOD FOR SECURING A DECK OR ROOF STRUCTURE TO A BRICK OR SIDING VENEERED BUILDING STRUCTURE

(71) Applicant: Robert P. Viviano, Coraopolis, PA (US)

(72) Inventor: Robert P. Viviano, Coraopolis, PA (US)

( * ) Notice: Subject to any disclaimer, the term of this patent is extended or adjusted under 35 U.S.C. 154(b) by 144 days.

(21) Appl. No.: 18/743,655

(22) Filed: Jun. 14, 2024

(65) Prior Publication Data

US 2025/0382788 A1 Dec. 18, 2025

(51) Int. Cl.
*E04B 1/26* (2006.01)

(52) U.S. Cl.
CPC .... *E04B 1/2612* (2013.01); *E04B 2001/2644* (2013.01)

(58) Field of Classification Search
CPC ..... E04B 1/2612; E04B 2001/2644
See application file for complete search history.

(56) References Cited

U.S. PATENT DOCUMENTS 414,169 A * 10/1889 Reuschel ..... E04B 1/2612 248/300
804,451 A * 11/1905 Carlson ..... E04B 1/2612 52/702
1,097,934 A * 5/1914 Price ..... F16B 9/058 52/702
4,124,962 A * 11/1978 Lancelot, III ..... E04B 1/2612 52/702
4,158,940 A * 6/1979 Lancelot, III ..... E04B 1/2612 52/702
4,353,664 A * 10/1982 Gilb ..... E04B 1/2612 52/702
4,422,792 A * 12/1983 Gilb ..... F16B 9/058 52/702
4,665,672 A * 5/1987 Commins ..... F16B 9/058 52/702
4,717,279 A * 1/1988 Commins ..... F16B 9/052 403/187
4,744,192 A * 5/1988 Commins ..... F16B 9/052 403/232.1
4,802,786 A * 2/1989 Yauger ..... E04B 1/2612 248/188
4,982,548 A * 1/1991 Abbey ..... E04B 1/0007 52/289
5,367,853 A * 11/1994 Bryan ..... E04B 5/12 52/289

(Continued)

*Primary Examiner* — Rodney Mintz
(74) *Attorney, Agent, or Firm* — Carothers and Carothers

(57) ABSTRACT

A joist or beam hanger for securing deck joist or roof beam ends to a brick or siding veneered wall of a building structure. A horizontal spaced series of apertures are provided in the brick or siding veneer and sized for respectively receiving deck joist or roof beam end brackets. The apertures are located at and expose the wall sill plate or top plate of the veneered building structure wall and the brackets have horizontally protruding sill flanges resting on top of the wall sill plate or top plate and lag screws secure the brackets to the wall and also directly to the sill plate or top plate. Floor joist or roof beam ends of a deck or roof structure are respectively secured to the joist or roof beam end brackets.

4 Claims, 9 Drawing Sheets

(56) References Cited

U.S. PATENT DOCUMENTS

| | | | | |
|---|---|---|---|---|
| 5,555,694 | A * | 9/1996 | Commins | F16B 9/058 248/300 |
| 6,463,711 | B1 | 10/2002 | Callies | |
| 8,028,494 | B2 * | 10/2011 | Denn | E04B 1/18 52/289 |
| 8,234,826 | B1 * | 8/2012 | Proffitt, Jr. | E02D 27/00 52/712 |
| 8,621,802 | B2 * | 1/2014 | Spyrou | E04B 1/388 52/489.1 |
| 9,151,058 | B1 | 10/2015 | Leathe | |
| 9,194,118 | B2 * | 11/2015 | Spyrou | E04B 2/56 |
| 10,358,812 | B2 * | 7/2019 | Jensen | E04B 1/2612 |
| 12,203,262 | B1 * | 1/2025 | Boor | E04B 7/024 |
| 2006/0016138 | A1 * | 1/2006 | Blount | E04B 5/40 52/263 |
| 2006/0156682 | A1 * | 7/2006 | McAndrew | E04B 1/2612 52/837 |
| 2008/0110121 | A1 * | 5/2008 | Edmends | E04B 1/2612 52/465 |
| 2009/0100796 | A1 * | 4/2009 | Denn | E04B 1/18 52/745.12 |
| 2010/0307094 | A1 * | 12/2010 | Spyrou | E04B 1/003 52/489.1 |
| 2015/0135630 | A1 | 5/2015 | Spyron | |
| 2018/0363289 | A1 * | 12/2018 | Jensen | E04B 1/388 |

* cited by examiner

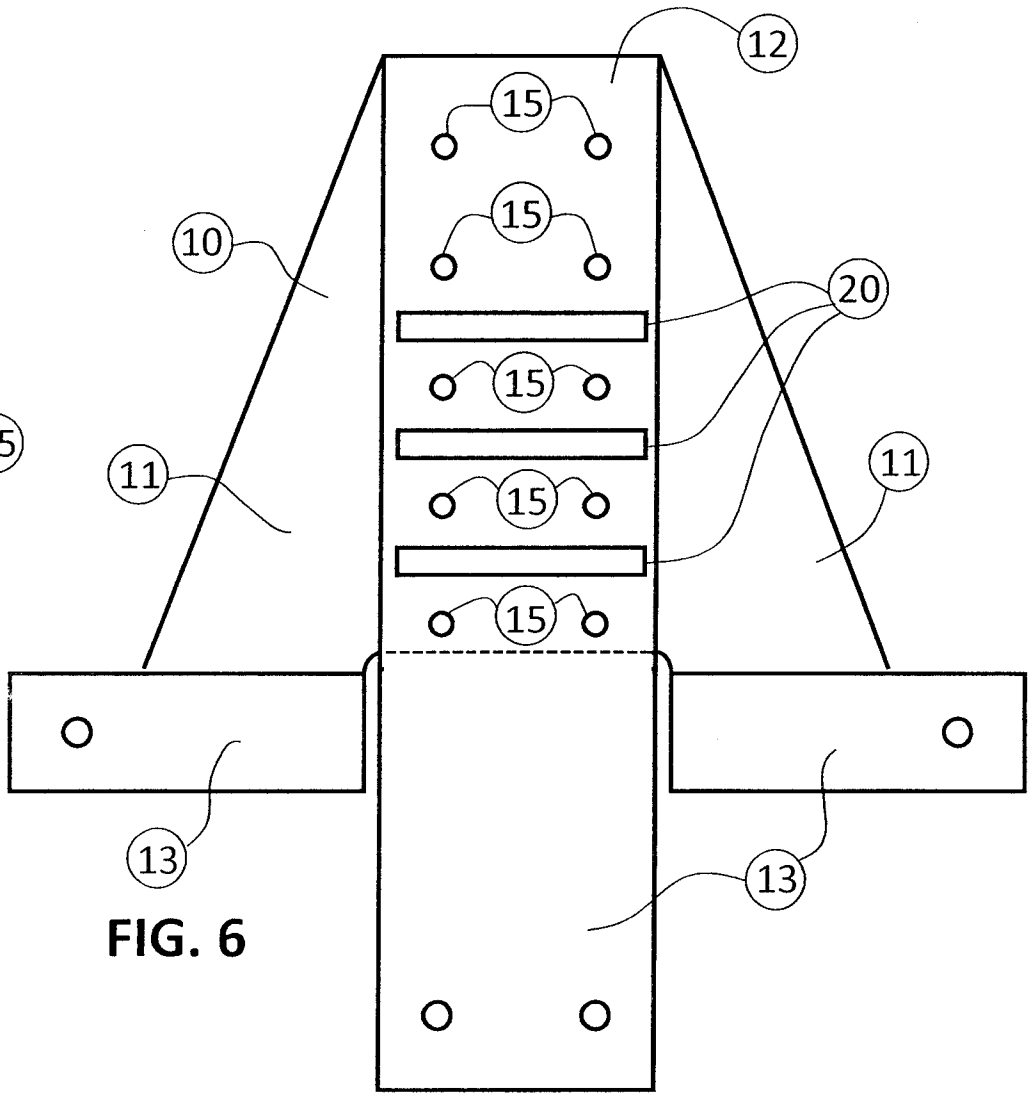
FIG. 6
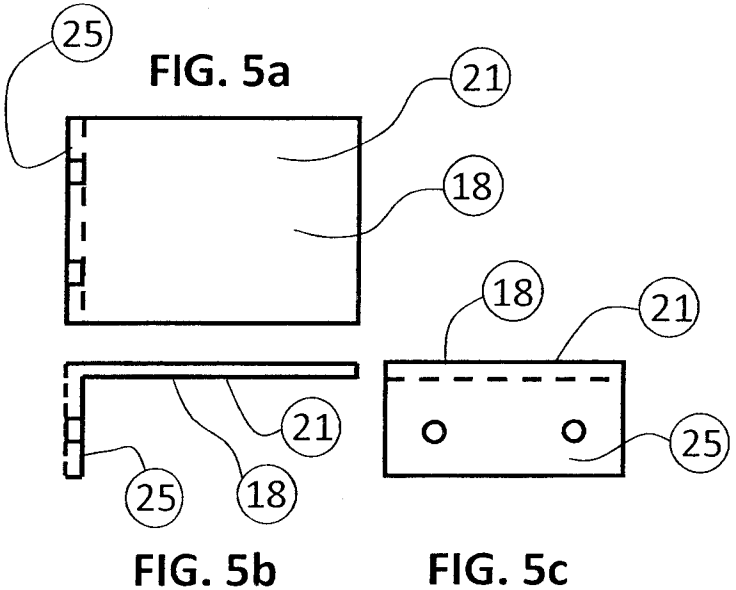
FIG. 5a
FIG. 5b
FIG. 5c

APPARATUS AND METHOD FOR SECURING A DECK OR ROOF STRUCTURE TO A BRICK OR SIDING VENEERED BUILDING STRUCTURE

BACKGROUND OF THE INVENTION

The invention relates to a bracket system for securing a deck or roof structure to a brick or siding veneered building structure, and more particularly to a method for securing such a deck or roof structure to a brick or siding veneered building structure.

A problem exists as how to connect a load bearing structure to a building having a brick or siding facing or veneer. Most building codes specify that a brick veneer can only support its own weight and cannot support additional loads, such as those from an outside structure as a deck or roof structure. In addition, code requirements for vertical and lateral load connection requirements must also be met.

It is accordingly recommended to add more posts and beams adjacent the veneered wall of the building structure to support a ledger, thereby not utilizing the brick veneer or siding to assist in supporting an adjacent deck or roof structure. However, this proposed solution requires the installation of posts and beams adjacent to the building structure which is unsightly, and poses additional problems, such as the requirement to dig footings near or on top of french drains or cutting into patios.

Typically, bricks must be removed for the entire area of the ledger, which is a difficult and expensive process.

Systems are available for new construction, but not for retrofit construction, which is the majority of the market. Simpson Strong-Tie Company, Inc. of Pleasonton, California manufactures a brick veneer ledger connector for retrofit installation of a ledger board to a veneered wall, but installers find this system to be very cumbersome to install.

U.S. Pat. No. 9,194,118 discloses a bracket for installation of a ledger from a brick veneered building structure. The disclosed bracket is an extruded aluminum product and it is doubtful that it could hold the load imposed by the ledger to the brackets. In addition, the horizontal plate 11 of the bracket could apparently apply unwanted flexing pressures to the brick veneer structure.

It is an object of the present invention to provide an easy, safe and secure method and apparatus for securing a deck or roof structure to a brick or siding veneered wall of a building structure without the limitations and problems presented by the prior art structures.

SUMMARY OF THE INVENTION

The prior art structures are all directed to the problem as to how to directly support a ledger board from a brick or siding veneered wall structure. To the contrary, the present invention solves the problem by instead supporting joist or beam ends from the veneered structure that in turn support the ledger and the connected deck or roof structure.

A deck or roof structure is secured to a brick or siding veneered wall of a building structure in accordance with the teachings of the present invention by first forming a horizontal spaced series of apertures through the brick or siding veneer, the apertures being sized to respectively receive joist or roof beam end hangers therein, with the apertures further exposing a wall sill plate or top plate in the wall.

Joist or roof beam end hangers with horizontally extending sill flanges are provided and inserted respectively in the brick or siding apertures, thereby engaging the hangers with the wall of the building structure and with the sill flanges resting on a wall sill plate or top plate of the building structure wall. The hangers are then secured to the wall, and also to the wall sill plate or top plate of the building structure, with lag bolts. Thereafter, the deck or roof structure is constructed adjacent to the building structure wall with floor joist or roof beam ends of the deck or roof structure secured in these hangers.

The joist or beam hangers of the present invention are metal joist or beam end brackets consisting of a pair of parallel spaced vertical side plates joined together with a vertical back end plate, and further include a bottom plate to thereby form a joist or beam end support pocket. The vertical back end plate includes multiple vertically spaced apertures for receiving lag bolts to secure the bracket to a building structure.

A metal sill rest support flange is adjustably securable to the vertical back end plate of the bracket at multiple different vertical positions and this sill rest support flange has a portion thereof horizontally extending from the vertical back end plate away from the support pocket. This sill rest support flange is vertically prepositioned on the vertical back end plate for resting on a wall sill plate or wall top plate of the building structure when the bracket is secured to the building structure. At least one of the vertically spaced apertures provided in the vertical back end plate is or are positioned to receive one of the lag bolts directly in the wall sill plate or wall top plate.

The remainder of the connecting deck or roof structure is then constructed directly from and connected to the deck joists or roof beams supported from the hangers, thereby eliminating the problem of trying to properly secure a ledger board to a brick or siding veneered wall, and further providing a connecting structure which will meet the requirements of all building codes which further provides secure connection of the deck or roof structure to the sill plate or double top plate of the veneered wall of the building structure.

The bracket system of the present invention satisfies both the vertical and lateral load connection code requirements, thereby eliminating the need for additional bolting code requirements for lateral loads and thereby providing a less invasive deck connection system in terms of lateral load devices.

BRIEF DESCRIPTION OF THE DRAWINGS

Other objects and advantages appear hereinafter in the following description and claims. The following drawings show, for the purpose of exemplification without limiting the scope of the present invention or the appended claims, certain practical embodiments of the present invention wherein:

FIGS. 5*a*, 5*b* and 5*c* illustrated respectively top, front and end views of a sill rest support flange which is an integral part of the joist or beam hanger of the present invention;

FIG. 6 shows a front view of one embodiment of the joist or beam hanger blank of the present invention before the hanger has been bent to form a hanger as illustrated in the embodiment shown in FIGS. 1, 2 and 3;

DETAILED DESCRIPTION OF THE DRAWINGS

Figure 1:
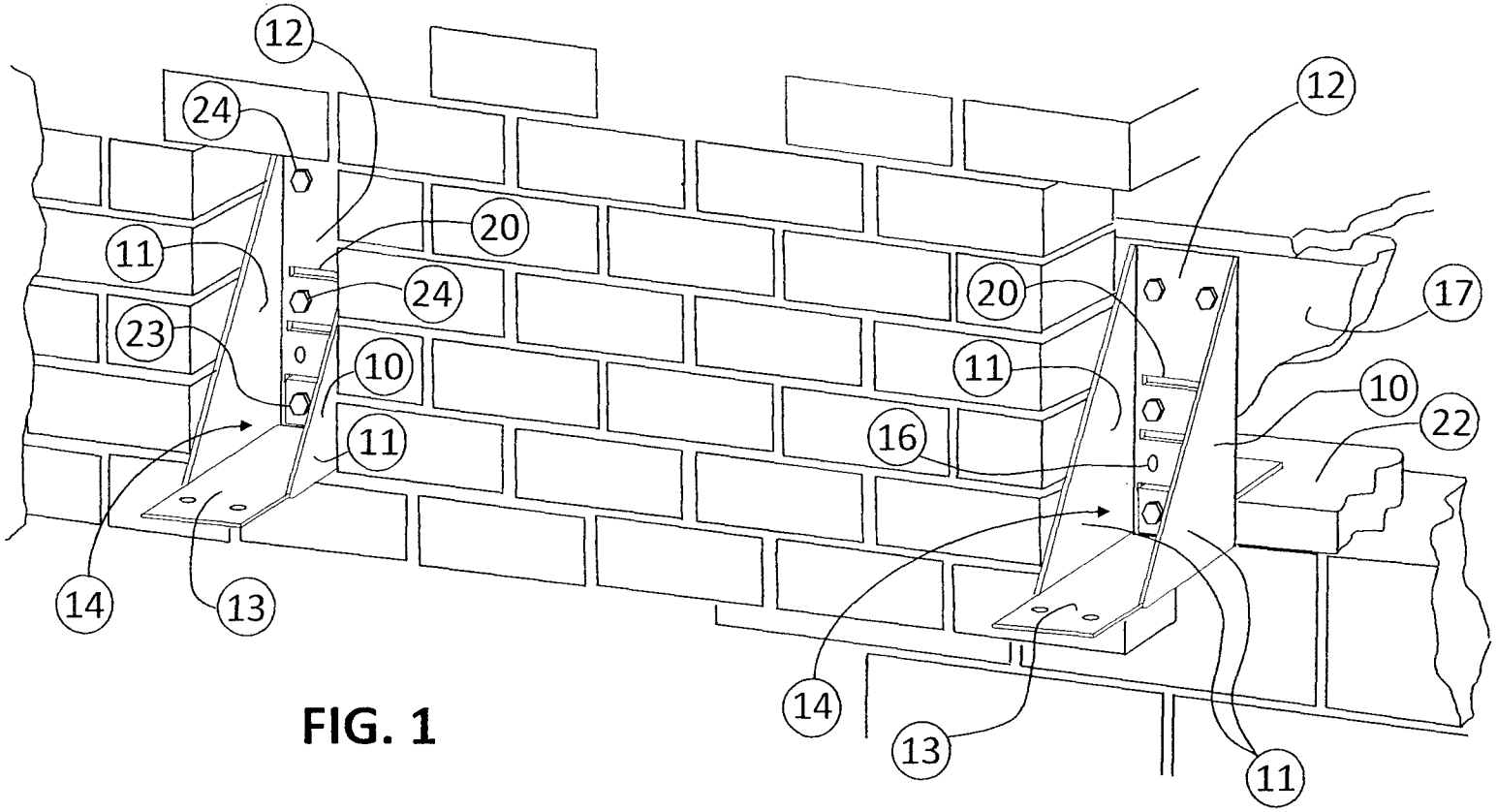
FIG. 1 is a front perspective view of a portion of a building structure having a brick veneer and with portions sectioned off to disclose interior portions of the building wall to which is installed a joist or beam hanger in accordance with the teachings of the present invention.
Figure 2:
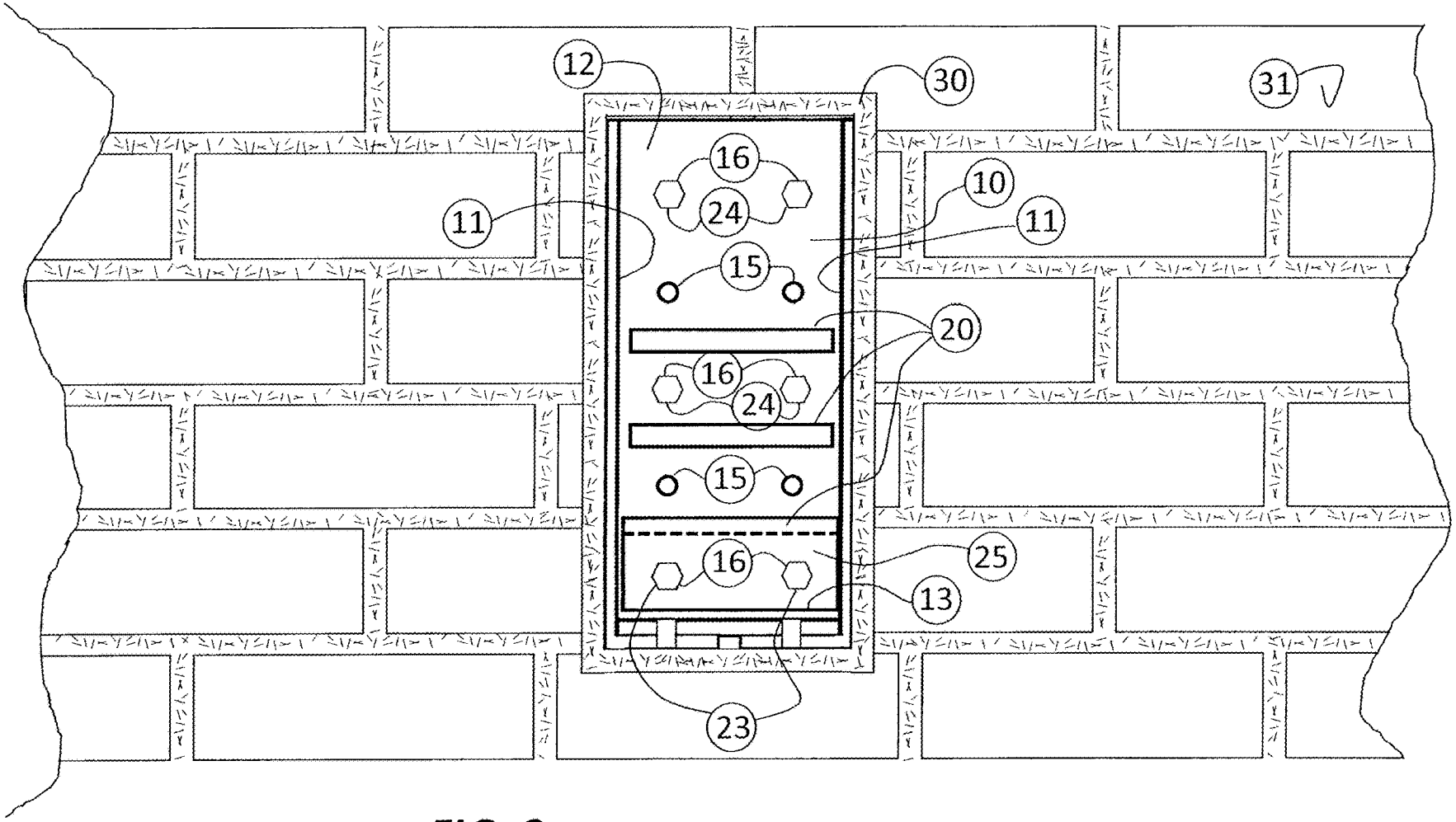
FIG. 2 is an enlarged frontal view of one of the joist or beam hangers shown in FIG. 1.

Referring to FIGS. 1 through 4, a first embodiment of the joist or bean hanger and the method of securing a deck structure to a brick veneered wall of a building structure is illustrated. A metal joist or beam end bracket 10 of the present invention consists of a pair of parallel spaced vertical side plates 11 joined together with a vertical back end plate 12, and further includes a bottom plate 13 to thereby form a joist or beam end support pocket 14.

Vertical back end plate 12 includes multiple vertically spaced apertures 15 for receiving lag bolts 16 to secure bracket 12 to building structure 17. Metal sill rest support flange 18 is adjustably securable to vertical end plate 12 at multiple different vertical positions as indicated at horizontal slots 20. A portion 21 of sill rest support flange 18 extends horizontally from vertical back end plate 12 away from pocket 14. Sill rest support flange 18 is vertically pre-positioned on vertical back end plate 12 for resting on wall sill plate 22 of building structure 17 when bracket 10 is secured to the building structure 17. The bottom most of the vertically spaced apertures 15 in this embodiment are positioned to receive the lag bolts 23 in wall sill plate 22 of the building structure 17.

Lag bolts 23 therefore not only secure bracket 10 directly to the sill plate 22, but in addition secure sill rest support flange 18 together with bracket 10. Bracket 10 is additionally secured to the wall structure 17 by means of lag bolts 24.

The sill rest support flange 18 is L-shaped having a vertical lip end portion 25 that is securable to vertical back end plate 12 in this embodiment by means of lag bolts 23. A portion of sill rest support flange 18 extends through one of the multiple vertically spaced horizontal slots 20 provided in vertical back end plate 12, and vertical lip end portion 25 is secured to the vertical back end plate with lag bolts 23 as previously indicated. Thus, depending upon desired positioning of brackets 10 relative to the building structure wall 17 to thereby ensure that sill rest support flange 18 will be positioned to be received directly on top of sill 22 of wall 17 of the building structure, sill rest support flange 18 may be vertically pre-positioned relative to bracket 10 by preselecting one of the horizontal vertically spaced slots 20.

Figure 3:
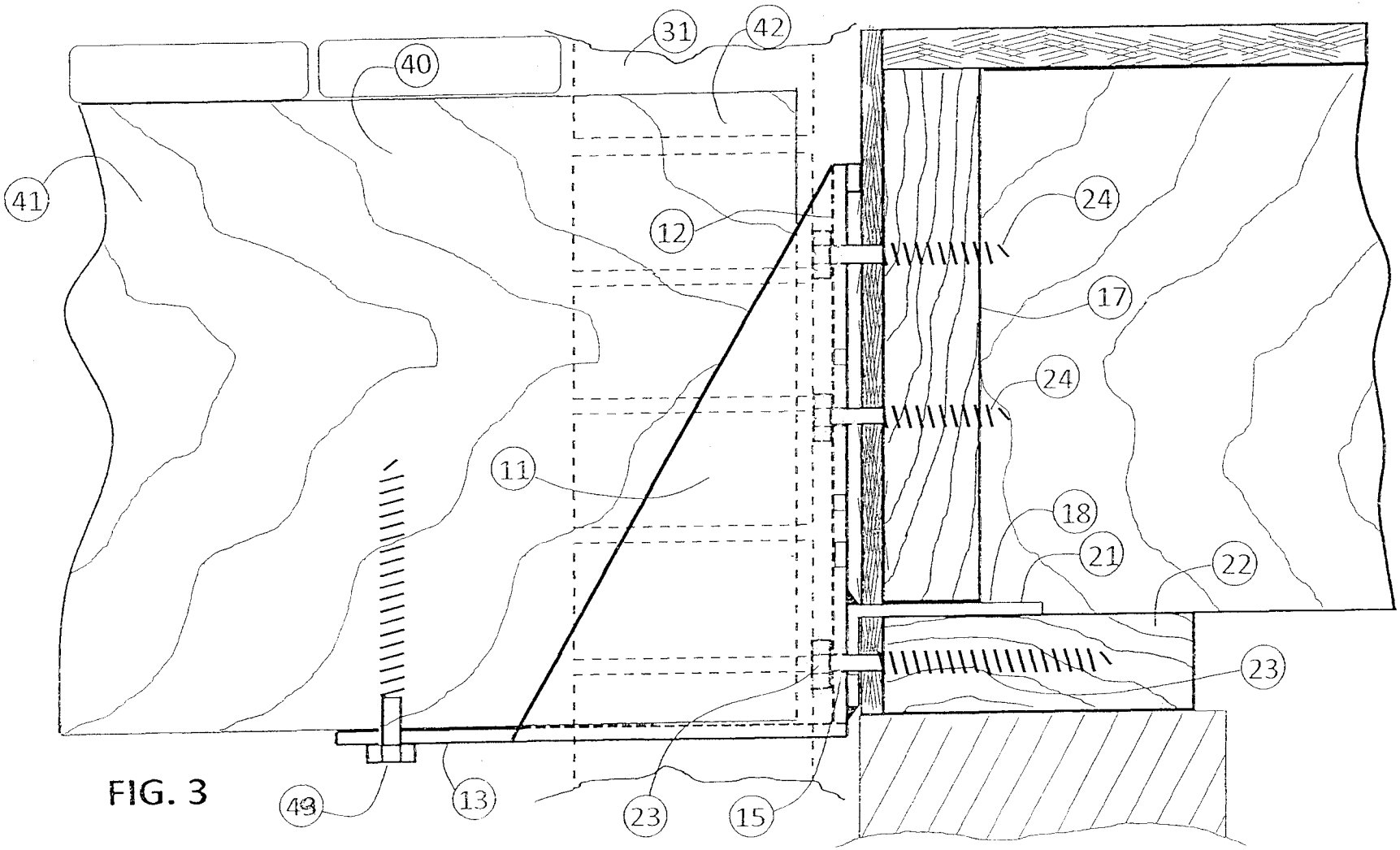
FIG. 3 is an enlarged sectional view in side elevation of the joist or beam hanger of the present invention illustrating its securement to the wall structure of the building structure illustrated in FIG. 1.
Figure 4:
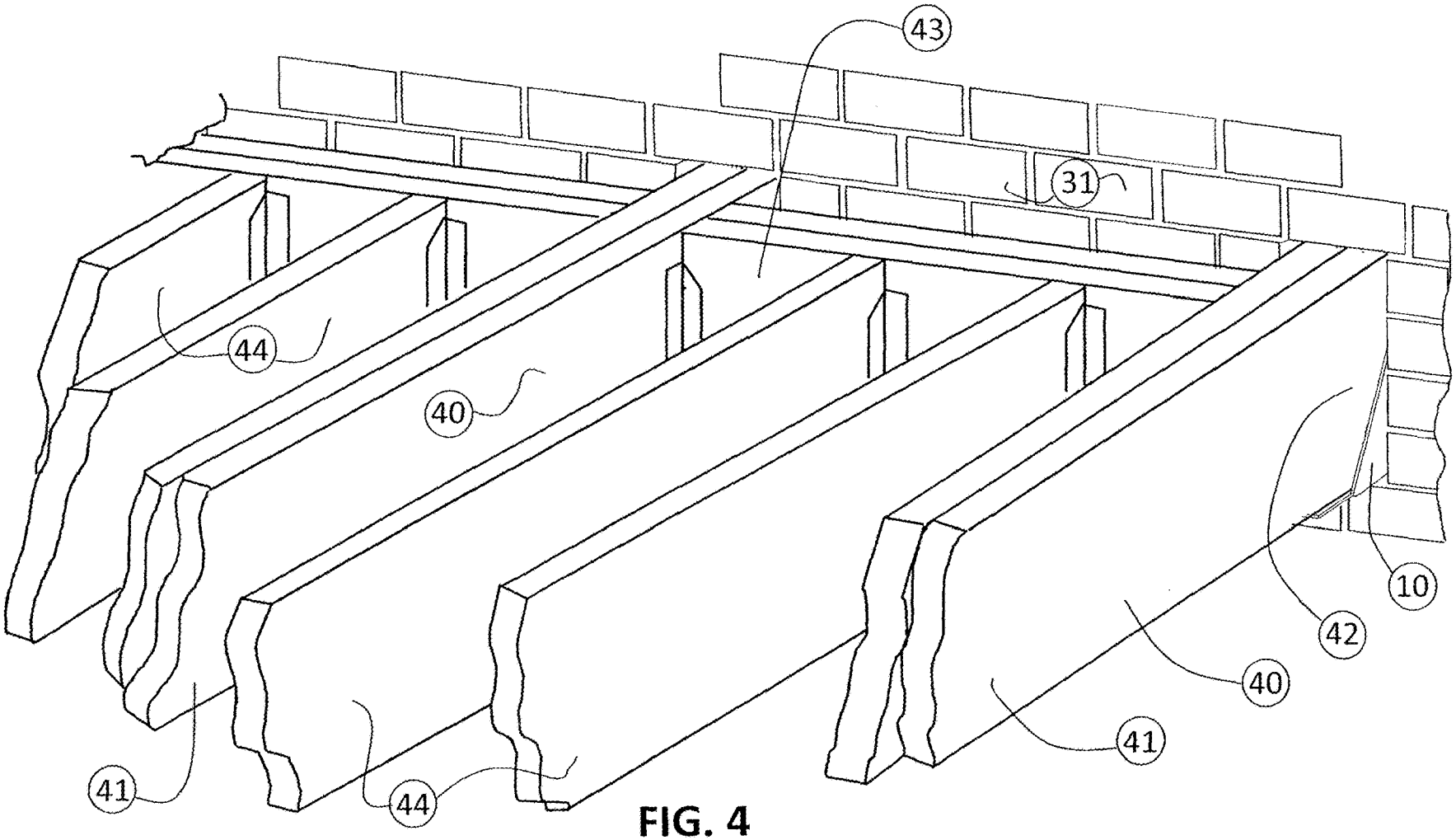
FIG. 4 shows a front perspective view of the building structure as illustrated in FIG. 1 with a deck structure secured to an extending from the joist or beam hangers of the present invention.

As an alternative, instead of bolting sill rest support flange 18 to back end plate 12 of bracket 10, sill rest support flange 18 may be welded to vertical back end plate 12 as illustrated in FIG. 3 prior to installation.

In preparation for installing joist or beam end brackets 10 areas 30 of the brick veneer 31 are removed with appropriate drilling and/or cutting tools to provide an opening through veneer 31 to thereby receive brackets 10 for engagement with the wall of building structure 17. Once brackets 10 are installed, appropriate caulking is applied about the perimeter of opening 30 as a weather seal. A deck structure 40 is then constructed to be supported from brackets 10 whereby twin joists 41 have their ends 42 resting in pockets 14 of brackets 10, wherein they are secured by means of lag bolts 49.

Construction of the deck structure 40 is thereafter continued by the addition of headers 43 secured between twin joists 40 and by thereafter continuing the deck construction with floor joists 44.

The resulting structure thereby satisfies both the vertical and lateral load connection code requirements for securing a deck structure to a brick or siding veneered building structure thereby eliminating the need for additional bolting code requirements for lateral loads and providing a less invasive deck connection systems in terms of presently available lateral load devices.

Figure 7:
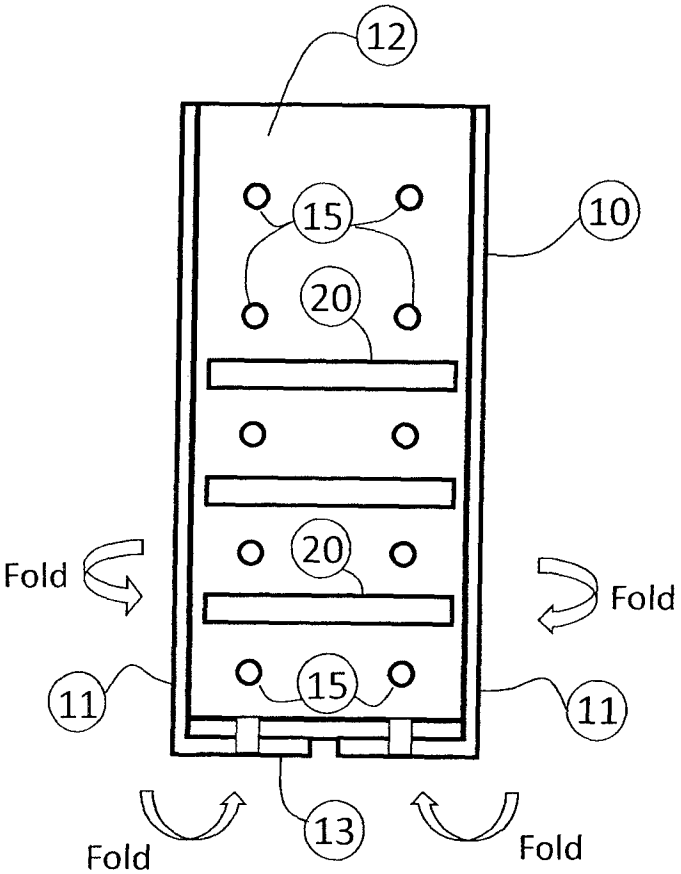
FIG. 7 is a view in front elevation of the hanger illustrated in FIG. 6 showing the folding pattern of the blank shown in FIG. 6 in order to shape the hanger to form the structure illustrated in FIGS. 1, 2 and 3.

Referring next to FIGS. 5 and 6, the sill rest support flange 18 is independently illustrated in FIGS. 5*a*, 5*b* and 5*c*, and in FIG. 6 the bracket 10 is illustrated in the form of a stamped blank ready to be appropriately folded to form the bracket 10 as illustrated in the previous figures. The folding pattern of the blank illustrated in FIG. 6 is demonstrated in FIG. 7.

Figure 8:
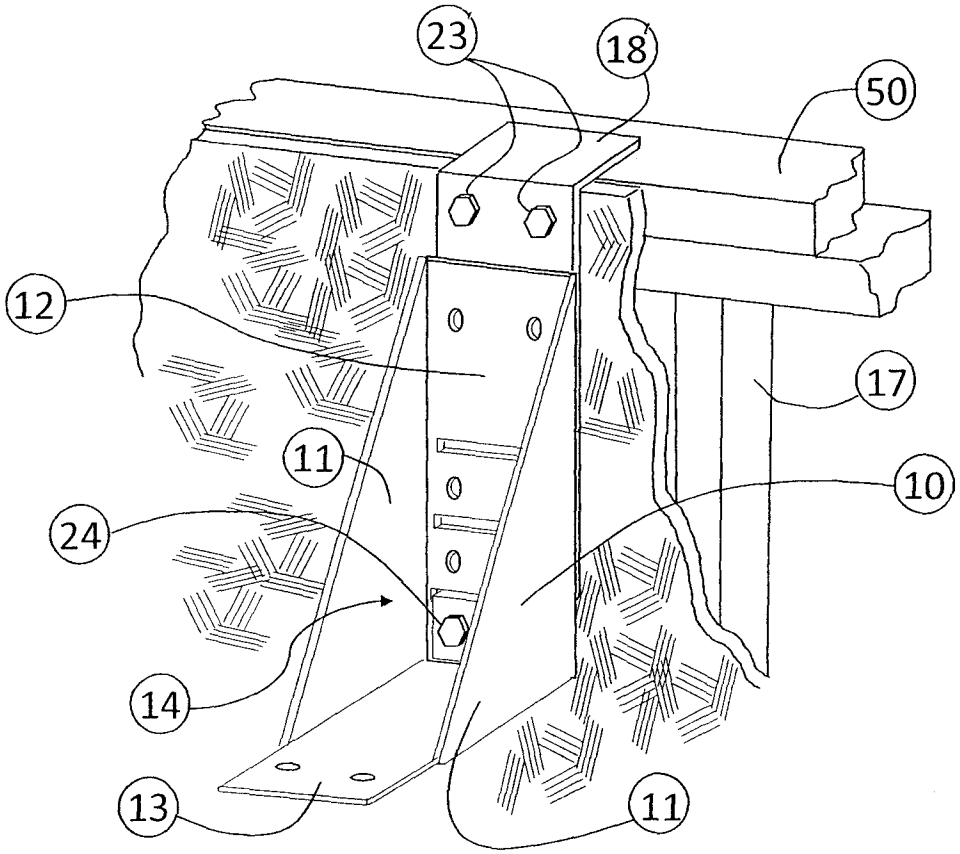
FIG. 8 is a front perspective view of another embodiment of the joist or beam hanger of the present invention as applied to the wall of a building structure on which the brick veneer has been removed for clarity.
Figure 9:
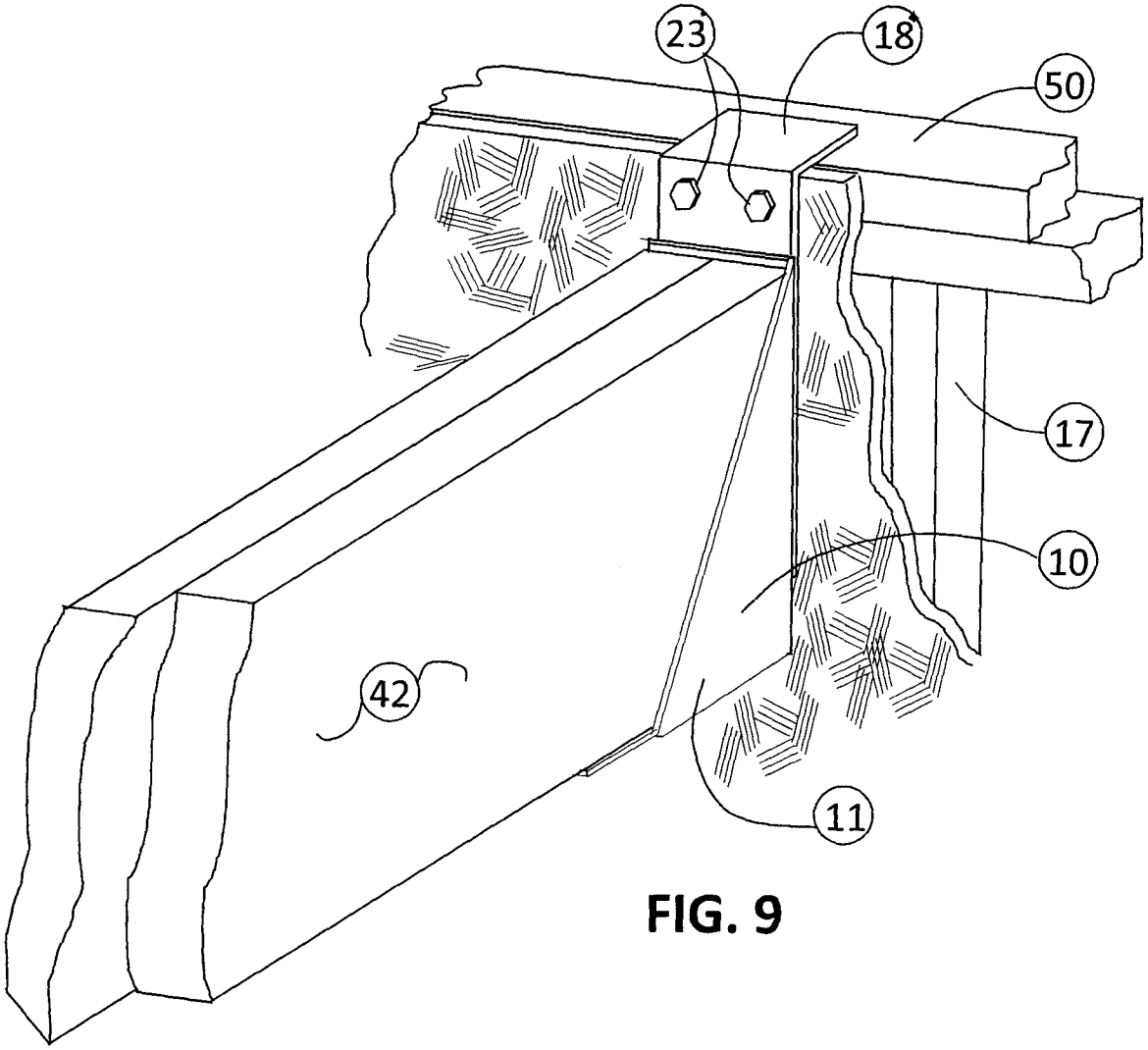
FIG. 9 illustrates the hanger structure of FIG. 8 with a double floor joist end received within the hanger structure.

Referring next to FIGS. 8 and 9, another embodiment of the joist or beam hanger of the present invention is illustrated for securing a deck structure to the double wall top plate 50 of a wall of the building structure 17, as opposed to connecting the bracket 10 to the sill plate as previously illustrated.

In this embodiment, the bracket 10 is identical to the bracket previously illustrated, but the sill rest support flange 18' is modified to the shape illustrated so that the bracket 10 can be appropriately supported from the double top plate 50. Note that similar to as before, the sill rest support flange 18' is secured directly to double top plate 15 via lag bolts 23'.

Figure 11:
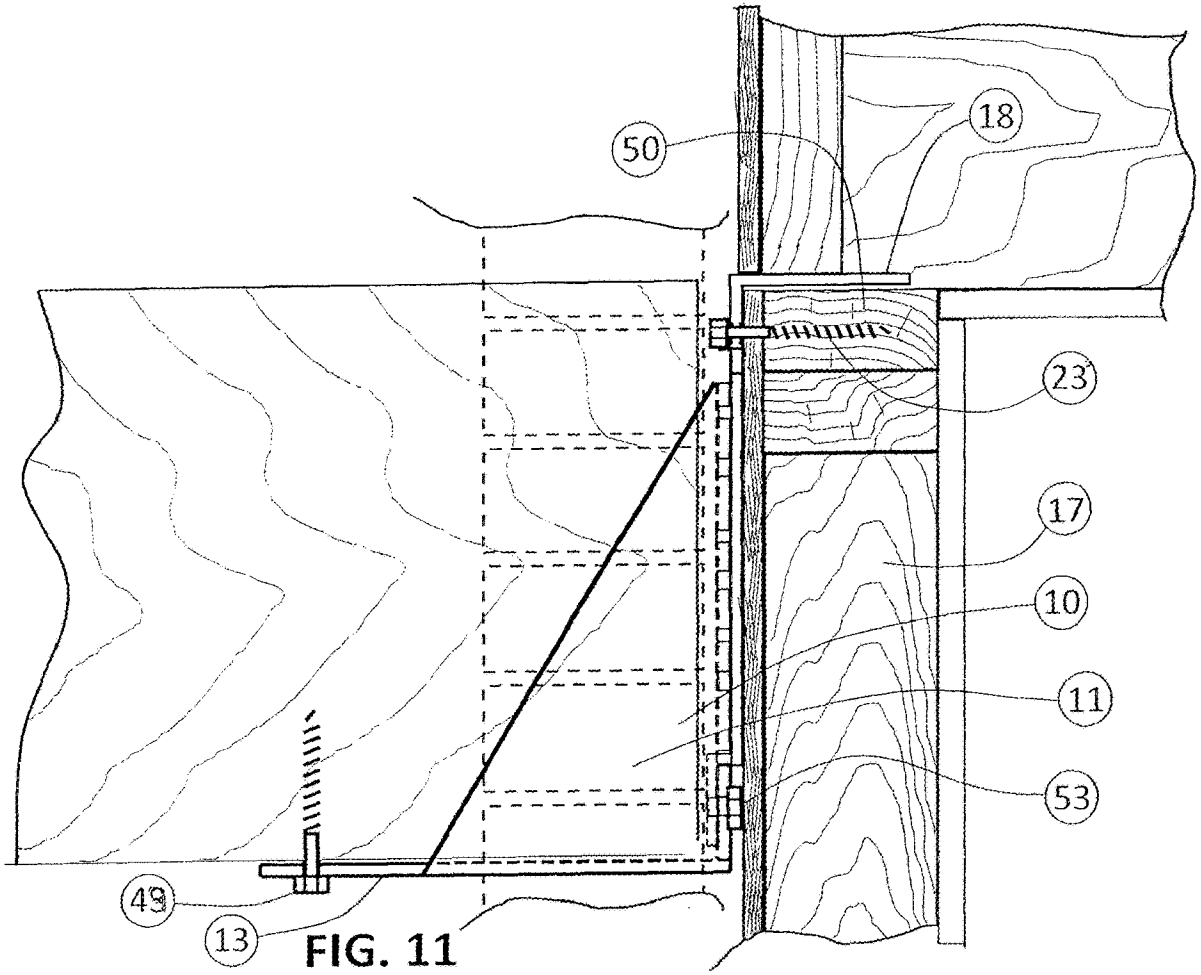
FIG. 11 is a sectional view in side elevation of the joist or beam hanger of the present invention utilizing the sill rest support flange illustrated in FIGS. 10*a* and 10*b* in support of a roof beam as secured to the wall of a brick veneered building.
Figure 10B:
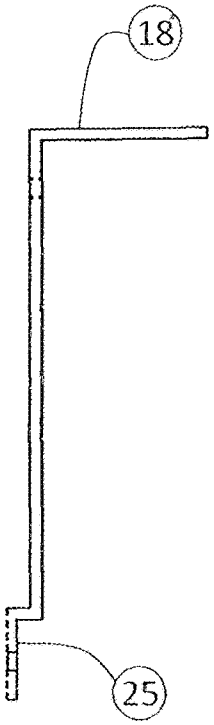
FIGS. 10*a* and 10*b* respectively shown front and side views of an alternative embodiment of the sill rest support flange that may be used in conjunction with the main body of the joist or beam hanger of the present invention for a roof beam support application.
Figure 10A:
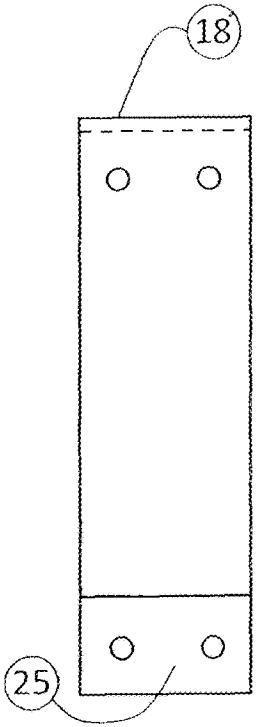
Figure 12:
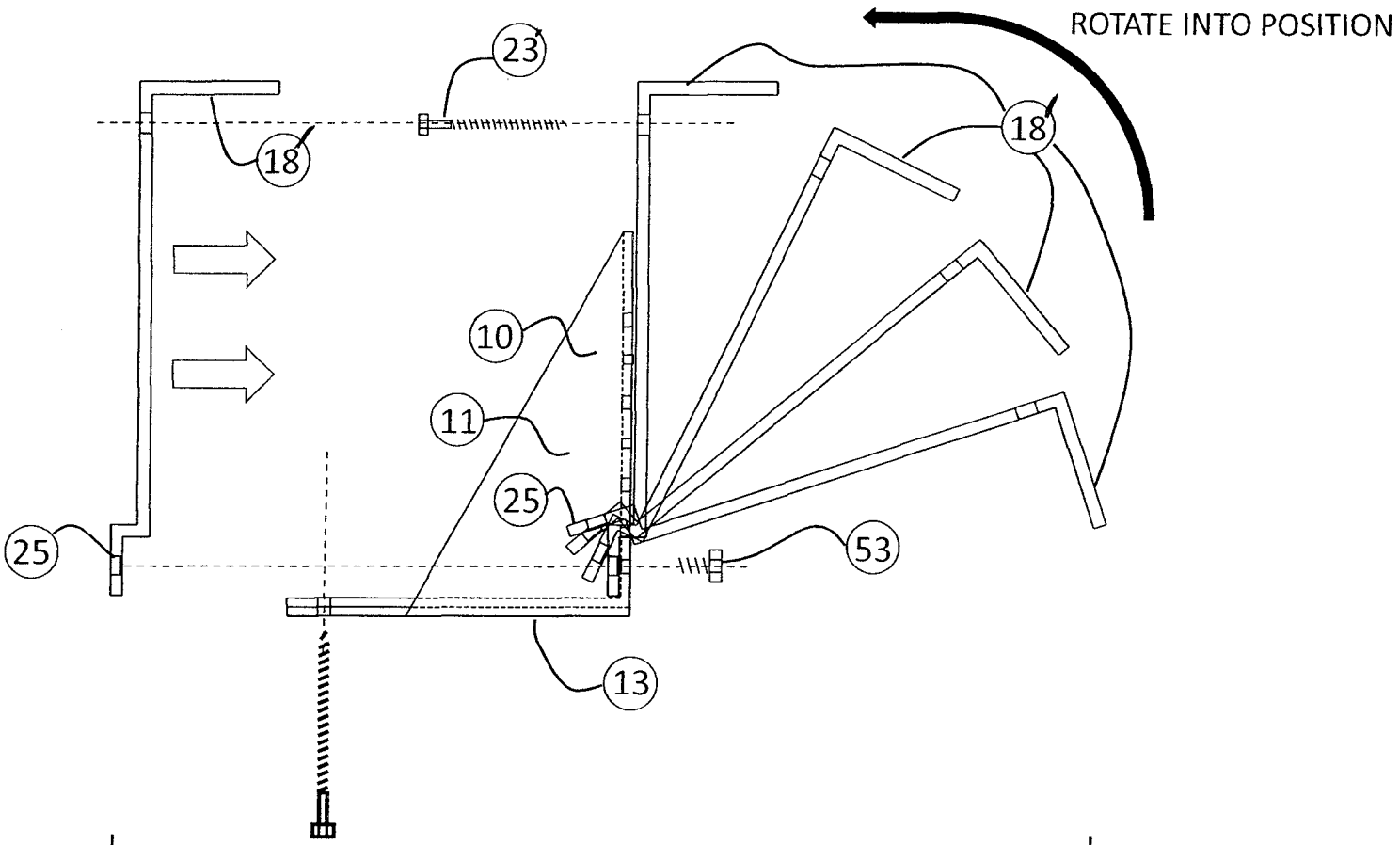
FIG. 12 is a diagrammatic view in side elevation illustrating the assembly of the sill rest support flange of FIGS. 10*a* and 10*b* with the main body or bracket of the joist or beam hanger illustrated in FIG. 11 in order to form the completed roof beam joist or beam hanger of the present invention.

FIGS. 11 and 12 illustrate yet another embodiment of the present invention wherein the joist or beam hanger of the present invention is utilized in a roof beam support application. In this embodiment the bottom end of flange 18' is secured to vertical back plate 12 by means of bolts 53. The assembly of flange 18' to bracket 10 is diagrammatically illustrated in FIG. 12. In this instance, double roof beam ends 42 are secured to brackets 10 for construction of a roof structure secured to the wall of the building structure.

I claim:

1. A system comprising:

a building structure having a wall sill plate or a wall top plate; and an adjustable joist or beam hanger securing one or more deck joist or roof beam ends to said building structure, the adjustable joist or beam hanger comprising:

a metal joist or beam end bracket consisting of a pair of parallel spaced vertical side plates joined together with a vertical back end plate and further including a bottom plate to thereby form a joist or beam end support pocket;

said vertical back end plate including multiple vertically spaced apertures configured to receive lag bolts to secure said end bracket to said building structure, an L-shaped metal sill rest support flange having a vertical support plate adjustably secured to said vertical back end plate at multiple different vertical positions and having a rest portion thereof horizontally extending from said vertical support plate and away from said pocket and vertically pre-positioned and secured on said vertical back end plate such that said rest portion is positioned on a said wall sill plate or said wall top plate of said building structure; and said vertical support plate of said sill rest support flange having at least one aperture receiving a respective said lag bolt therethrough securing said end bracket and said sill rest support flange to said wall sill plate or said wall top plate.

2. The system of claim 1, wherein said sill rest support flange having a vertical lip end portion that is securable to said vertical back end plate.

3. The system of claim 2, wherein a portion of said sill rest support flange extends through one of multiple vertically spaced horizontal slots provided in said vertical back end plate, and said vertical lip end portion is secured to said vertical back end plate with one or more of said lag bolts.

4. The system of claim 2, wherein said vertical lip end portion is welded to said vertical back end plate.

* * * * *